US009409438B2

(12) United States Patent
Ohtsuka

(10) Patent No.: US 9,409,438 B2
(45) Date of Patent: Aug. 9, 2016

(54) WRITING INSTRUMENT WITH ERASING MEMBER

(71) Applicant: MITSUBISHI PENCIL COMPANY, LIMITED, Tokyo (JP)

(72) Inventor: Hiroshi Ohtsuka, Yokohama (JP)

(73) Assignee: Mitsubishi Pencil Company, Limited, Tokyo (JP)

( * ) Notice: Subject to any disclaimer, the term of this patent is extended or adjusted under 35 U.S.C. 154(b) by 118 days.

(21) Appl. No.: 14/362,790

(22) PCT Filed: Dec. 4, 2012

(86) PCT No.: PCT/JP2012/081392

§ 371 (c)(1),
(2) Date: Jun. 4, 2014

(87) PCT Pub. No.: WO2013/084894

PCT Pub. Date: Jun. 13, 2013

(65) Prior Publication Data

US 2014/0331448 A1 Nov. 13, 2014

(30) Foreign Application Priority Data

Dec. 9, 2011 (JP) ..... 2011-270080
May 30, 2012 (JP) ..... 2012-123324

(51) Int. Cl.

| | |
|---|---|
| ***B43K 3/00*** | (2006.01) |
| ***B43K 23/12*** | (2006.01) |
| ***B43L 19/00*** | (2006.01) |
| ***B43K 29/02*** | (2006.01) |

(Continued)

(52) U.S. Cl.

CPC ..... *B43L 19/0068* (2013.01); *B43K 3/00* (2013.01); *B43K 7/00* (2013.01); *B43K 7/005* (2013.01); *B43K 7/02* (2013.01); *B43K 23/02* (2013.01); *B43K 23/124* (2013.01); *B43K 23/126* (2013.01); *B43K 25/022* (2013.01); *B43K 25/026* (2013.01); *B43K 29/02* (2013.01); *B43L 19/0025* (2013.01); *B43L 19/0075* (2013.01); *B43L 19/0087* (2013.01)

(58) Field of Classification Search

CPC ..... B43K 3/00; B43K 29/02; B43K 23/124; B43K 23/126; B43L 19/0075

See application file for complete search history.

(56) References Cited

U.S. PATENT DOCUMENTS 1,224,992 A * 5/1917 Ziemer ..... B43K 29/02 15/427
1,847,163 A * 3/1932 Hehl ..... B43K 3/00 15/444

(Continued)

FOREIGN PATENT DOCUMENTS

JP 60-138774 U 9/1985
JP 06-075780 U 10/1994

(Continued)

*Primary Examiner* — Randall Chin
(74) *Attorney, Agent, or Firm* — Foley & Lardner LLP

(57) ABSTRACT

A writing instrument (1) is provided with an erasing member (2) mounted to the rear end section of the writing instrument body (3) or to the front end section of a cap (4). The end section has a fitting section (14) which is disposed on the center axis and a connection section (15) which connects the end section and the fitting section (14). The erasing member (2) has a fitting hole (2*c*) which receives both the fitting section (14) and the connection section (15). When the erasing member (2) is mounted in position, a gap space (17) is formed around the connection section (15).

4 Claims, 16 Drawing Sheets

(51) Int. Cl.

| | |
|---|---|
| ***B43K 7/02*** | (2006.01) |
| ***B43K 25/02*** | (2006.01) |
| ***B43K 7/00*** | (2006.01) |
| ***B43K 23/02*** | (2006.01) |

(56) References Cited

U.S. PATENT DOCUMENTS

| | | | | | |
|---|---|---|---|---|---|
| 1,998,472 | A * | 4/1935 | Watrous | B43K 29/02 | 15/429 |
| 2,569,704 | A * | 10/1951 | Weiss | B43K 29/02 | 15/427 |
| 2,815,002 | A * | 12/1957 | Clell | B43K 29/02 | 15/428 |
| 6,565,275 | B2 * | 5/2003 | Brand | B43K 19/00 | 15/425 |
| 7,730,578 | B1 * | 6/2010 | Curren | B43L 19/00 | 15/427 |
| 2002/0159817 | A1 | 10/2002 | Brand et al. | | |
| 2010/0266326 | A1 * | 10/2010 | Chuang | B43K 23/124 | 401/98 |

FOREIGN PATENT DOCUMENTS

| | | | |
|---|---|---|---|
| JP | 08-090984 | A | 4/1996 |
| JP | 10-217673 | A | 8/1998 |
| JP | 2003-200694 | A | 7/2003 |
| JP | 2004-148744 | A | 5/2004 |
| JP | 2005-081743 | A | 3/2005 |
| JP | 2006-123337 | A | 5/2006 |
| JP | 2009-214515 | A | 9/2009 |
| JP | 2010-260218 | A | 11/2010 |
| JP | 2011-079206 | A | 4/2011 |

* cited by examiner

WRITING INSTRUMENT WITH ERASING MEMBER

CROSS-REFERENCE TO RELATED APPLICATIONS

This application is a National Stage application of PCT/JP2012/081392, filed Dec. 4, 2012, which claims priority from Japanese patent application nos. JP 2011-270080, filed Dec. 9, 2011 and JP 2012-123324, filed May 30, 2012.

TECHNICAL FIELD

The present invention relates to a writing instrument which is provided with an erasing member.

BACKGROUND ART

Known in the art is a writing instrument which is provided with a separate erasing member at a top part of a cap whereby marks which are made by that writing instrument on a paper surface etc. can be erased by the erasing member (for example, PLT 1).

Further, PLT 2 describes an attachment structure for attaching a soft member corresponding to an erasing member to the top end part of a body or cap or other tubular member of a writing instrument. According to the attachment structure which is described in PLT 2, a projecting part is provided at the top end part of a tubular member, an attachment hole is provided at the bottom end part of the erasing member, and the projecting part is inserted into the attachment hole for engagement to thereby attach it.

CITATION LIST

Patent Literature

[PLT 1] Japanese Patent Publication No. 2003-200694A
[PLT 2] Japanese Patent Publication No. 2009-214515A

SUMMARY OF THE INVENTION

Problems to be Solved by the Invention

The writing instrument which is described in PLT 1 is predicated on the erasing member being replaced when worn etc., so the cap and the erasing member are not strongly attached. For this reason, when using the erasing member to erase a mark, looseness occurs between the cap and erasing member and stable erasing sometimes is difficult.

As opposed to this, according to the attachment structure which is described in PLT 2, while it is possible to strongly attach the erasing member, the contact area between the outer circumferential surface of the projecting part of the tubular member and the inner circumferential surface of the attachment hole of the erasing member increases in accordance with insertion of the projecting part into the attachment hole. That is, therefore, the force countering the frictional resistance which is required when inserting the projecting part into the attachment hole, that is, the press-fitting force, also increases accordingly and insertion of the projecting part firmly deep into the attachment hole is difficult.

The present invention has as its object the provision of a writing instrument which is provided with an erasing member which can be easily attached. Further, the present invention has as its object the provision of a writing instrument which is provided with an erasing member which is firmly attached.

Means to Solve the Problems

In a first aspect of the present invention, there is provided a writing instrument which comprises an erasing member which is attached to a back end part of a writing instrument body or a front end part of a cap, wherein the end part has a fitting part which is arranged on a center axis and a connecting part which connects the end part and the fitting part, the erasing member has a fitting hole which receives the fitting part and the connecting part, and, in a state where the erasing member is attached, a clearance space is formed around the connecting part.

That is, in the present aspect, a clearance space is formed around the connecting part. Therefore, even when attaching the erasing member, this clearance space exists. For this reason, the frictional resistance which accompanies attachment of the erasing member is reduced compared with the past, so the advantageous effect is exhibited that the erasing member can be easily attached. Note that, in this Description, in the axial direction of the writing instrument, the writing tip part side is defined as the "front" side, while the side opposite to the writing tip part is defined as the "back" side. Further, in the axial direction of the cap, the open end side where the writing instrument body is inserted is defined as the "back" side, while the opposite side to that is defined as the "front" side.

In a second aspect of the present invention, there is provided a writing instrument characterized by further comprising a supporting wall which surrounds part of the erasing member, the side surface of the part of the erasing member is provided with an engagement projecting part, and the engaging projecting part and an inner circumferential surface of the supporting wall abut against each other.

That is, in the present aspect, the erasing member is held by the erasing member and supporting wall abutting against each other, so at the time of an erasing operation by the erasing member, stable erasing becomes possible without looseness. That is, strong attachment of the erasing member can be realized.

In a third aspect of the present invention, there is provided a writing instrument characterized in that a flat part is provided at the side surface of the part of the erasing member.

That is, in the present aspect, when forming the erasing member by injection molding, the flat part can be made the gate position. As a result, even if gate residue is left, since there is a clearance between the surface of the flat part and the inner circumferential surface of the supporting wall, the gate residue can be prevented from contacting the inner circumferential surface and trouble at the time of attachment can be prevented.

In a fourth aspect of the present invention, there is provided a writing instrument characterized in that the entrance part of said fitting hole has a tapered shape taper part which becomes narrower the further toward the back.

That is in the present aspect, by the entrance part of the fitting hole being made a tapered shape, insertion of the fitting part becomes easy.

Effects of the Invention

According to the present invention, the advantageous effect is exhibited of providing a writing instrument which is provided with an erasing member which can be easily attached. Furthermore, according to the present invention, the advantageous effect is exhibited of providing a writing instrument which is provided with an erasing member which is strongly attached. Below, the present invention will be able to be understood more sufficiently from the attached figures and the description of the preferred embodiments of the present invention.

DESCRIPTION OF EMBODIMENTS

Figure 1:
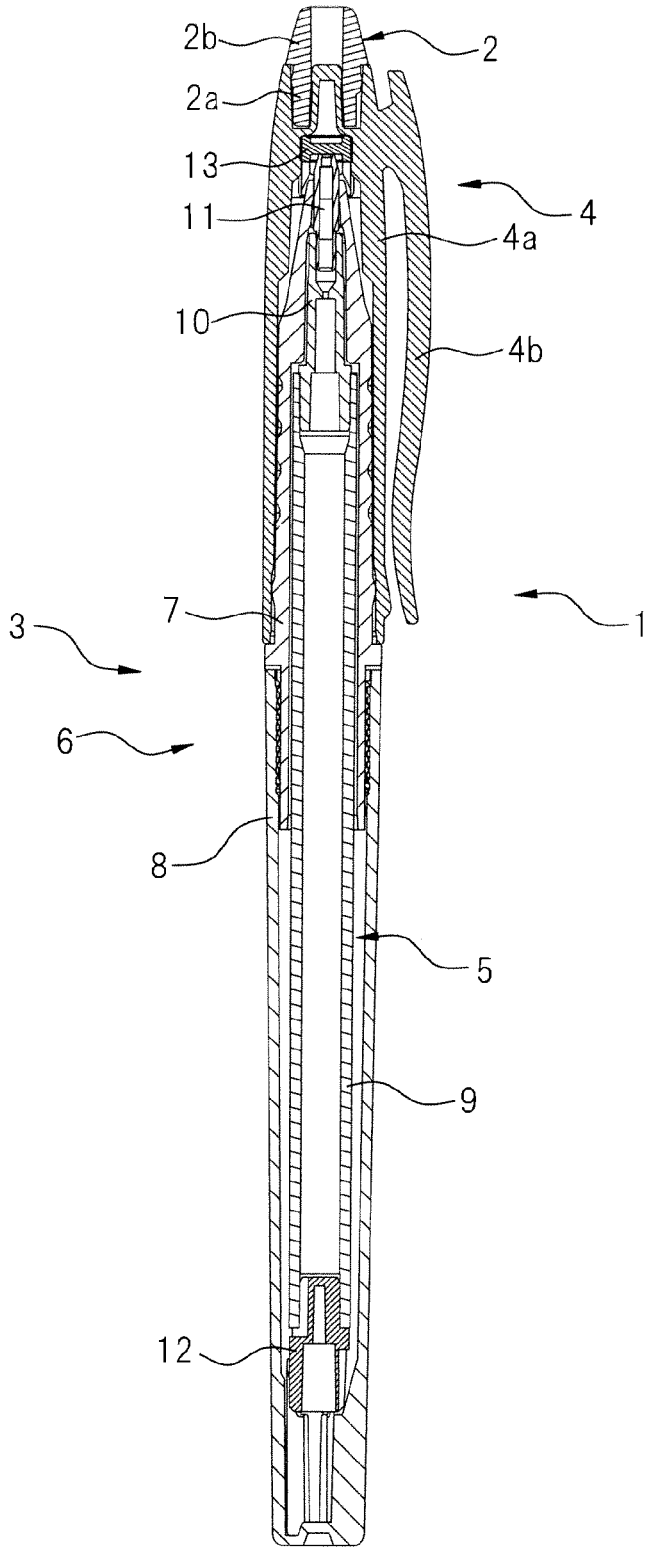
FIG. 1 is a vertical cross-sectional view of a writing instrument according to a first embodiment which is provided with an erasing member according to one aspect of the present invention.

Below, embodiments of the present invention will be explained in detail while referring to the drawings. Throughout the figures, corresponding elements are assigned common reference signs.

FIG. 1 is a vertical cross-sectional view of a writing instrument 1 according to a first embodiment which is provided with an erasing member 2 according to one aspect of the present invention. The writing instrument 1 is a ball pen type of writing instrument which has a writing instrument body 3, which is provided with a refill 5 and a cylinder 6 which extends in a tubular shape, and a cap 4. The cylinder 6 has a tubular front cylinder 7 and a back cylinder 8 with a front end part which screws into a back end part of the front cylinder 7. The front cylinder 7 and back cylinder 8 are formed from a plastic material. For example, in the present aspect, the front cylinder 7 is formed from a polypropylene plastic, while the back cylinder 8 is formed from a polycarbonate plastic. By forming the front cylinder 7 from a material which is softer than the material of the later explained cap 4, it becomes possible to prevent breakage at the time of fitting. At the front end of the front cylinder 7, a hole is formed for allowing the writing tip part 11 of the refill 5 to stick out. Note that, in the present Description, in the axial direction of the writing instrument 1, the writing tip part side is defined as the "front" side, while the side opposite to the writing tip part is defined as the "back" side. Further, in the axial direction of the cap 4, the opening end side in which the writing instrument body is inserted is defined as the "back" side, while the opposite side to that is defined as the "front" side.

The refill 5 has a tubular refill body 9, coupling member 10, writing tip part 11, and refill stopper 12. The refill body 9 is, for example, formed from a plastic material such as polypropylene or a metal material and is designed to store ink. The coupling member 10 is, for example, formed from polypropylene, polybutylene terephthalate, polyacetal, or other such plastic material or a metal material. Further, in the front end part of the coupling member 10, the back end part of the writing tip part 11 is fit. The refill 5 is housed inside the cylinder 6. Part of the writing tip part 11 is exposed through the hole of the above-mentioned front cylinder 7 in the state stored in the cylinder 6. The writing tip part 11 which forms the writing part holds a ball at its tip. In accordance with rotation of the ball at the time of writing, the ink which is stored at the refill body 9 part is discharged through the inside of the coupling member 10. At the back end part of the refill body 9, the refill stopper 12 is press fit. It is attached by fitting by this press fit.

The cap 4 has a cap body 4*a*, a clip part 4*b*, a seal member 13, and an erasing member 2. The cap body 4*a* is a tubular member. At its side surface, the clip part 4*b* is integrally provided. The clip part 4*b* is designed to have enough elasticity to enable a document, clothing, or other object to be gripped with the cap body 4*a*. Therefore, as the material which forms the cap body 4*a* and clip part 4*b*, polycarbonate, acrylonitrile-butadiene-styrene, or other plastic may be mentioned. As explained above, these parts are preferably formed by a material which is harder than the front cylinder 7.

Further, the seal member 13 protects the writing tip part 11 by elastically deforming when engaging with the writing tip part 11 when the cap 4 is attached over the front cylinder 7. As the material which forms the seal member 13, isopropylene rubber, butadiene rubber, nitrile rubber, silicone rubber, butyl rubber, ethylene-propylene-diene rubber, styrene-butadiene rubber, fluororubber, and other synthetic rubber etc. may be mentioned. In particular, butyl rubber (IIR) can much better improve the processability and the performance in prevention of evaporation at the tip of the writing part. That is, butyl rubber is not only excellent in processability, but also is particularly excellent in gas tightness (barrier property) among the various types of rubber. For this reason, by forming the seal member by butyl rubber, it is possible to more reliably prevent drying of the writing instrument tip and prevent evaporation of the solvent ingredient in the ink.

Figure 2:
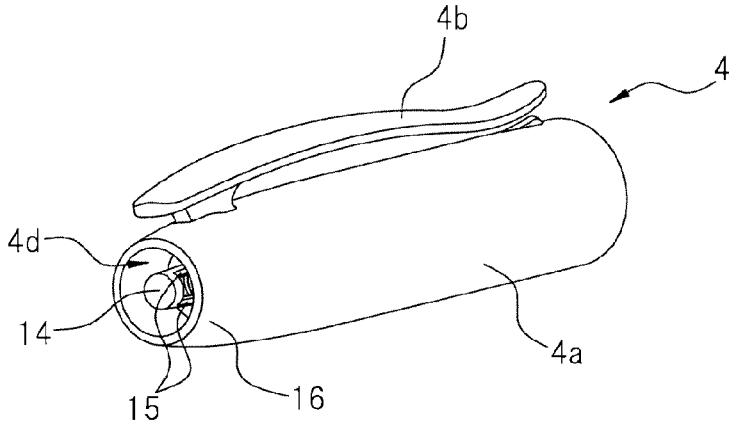
FIG. 2 is a perspective view of a cap of the writing instrument which is shown in FIG. 1.
Figure 3:
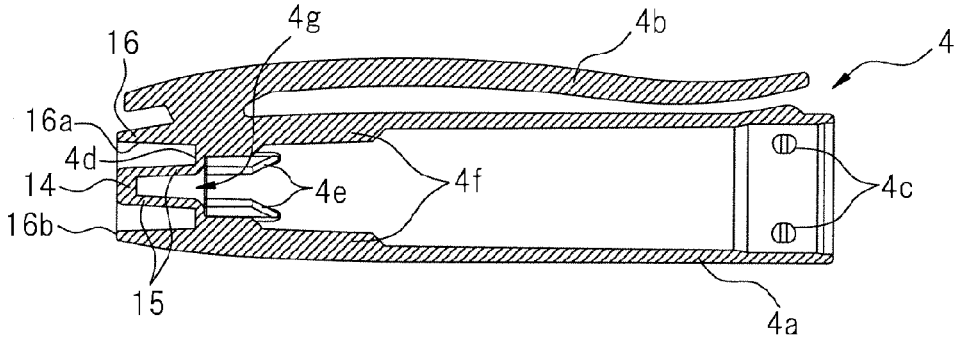
FIG. 3 is a vertical cross-sectional view of the cap which is shown in FIG. 2.
Figure 4:
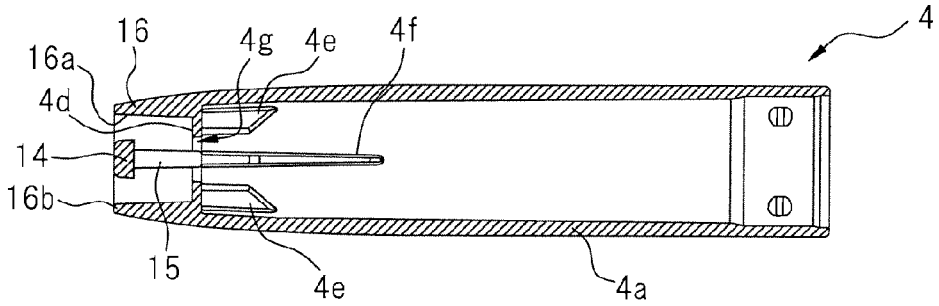
FIG. 4 is another vertical cross-sectional view of the cap which is shown in FIG. 2.

Next, while referring to FIG. 2 to FIG. 4, the structure of the cap 4 will be explained. FIG. 2 is a perspective view of the cap 4 of the writing instrument which is shown in FIG. 1, FIG. 3 is a vertical cross-sectional view of the cap 4 which is shown in FIG. 2, and FIG. 4 is another vertical cross-sectional view of the cap 4 which is shown in FIG. 2. FIG. 4 is a cross-sectional view at a position rotated 90 degrees about the center axis from the cross-sectional view which is shown in FIG. 3.

At the inside wall of the cap body 4*a* near the open end, an engagement part 4*c* which engages with the front cylinder 7 is provided. At the front end part 4*d* of the cap body 4*a*, that is, inside near the top part, three or more ribs 4*e* which extend in the axial direction of the writing instrument 1 are provided at equal intervals in the circumferential direction. In this aspect, the cap body 4*a* has six ribs 4*e*. As shown in FIG. 1, the seal member 13 is gripped by the ribs 4*e*.

The ribs 4*e* respectively have equal axial direction lengths, but it is also possible to have only two ribs (long ribs) 4*f* which are arranged facing each other across the center axis extend longer toward the back of the cap 4 compared with the other ribs 4*e*. These long ribs 4*f* act as guides at the time of insertion of the seal member 13 when assembling the cap 4 and facilitate insertion. Further, when the cap 4 is formed from a transparent or semitransparent material, one of these long ribs 4*f* may also be arranged at a position corresponding to right below the clip part 4*b* which extends in the long direction. Due to this, the clip part 4*b* and the facing long rib 4*f* will be arranged on substantially the same plane which passes through the center axis of the cap 4 and will give an aesthetic feeling.

At the front end part 4*d* of the cap body 4*a*, a fitting part 14 which is arranged on the center axis, two connecting parts 15 which connect the end part 4*d* and fitting part 14, and a supporting wall 16 which is arranged around the fitting part 14 and connecting parts 15 are provided. Further, at the front end part 4*d* of the cap body 4*a*, a circular vent opening 4*g* is provided about the center axis, but the vent opening 4*g* may also be omitted.

The fitting part 14 has a frustoconical shape which has a back end part which is large in diameter and which becomes smaller in diameter the further to the front end part. The front end face edge 14*a* part of the fitting part 14 is chamfered round. Further, the hack end face edge 14*b* part has a 90 degree or sharp angle corner part 14*c*. The shape of the fitting part 14 is not limited to a frustoconical shape and may also be a sphere, column, polygonal prism shape, etc.

The connecting parts 15 are two columnar members which extend from the inside wall of the vent opening 4*g* toward the front of the cap 4 and which are arranged symmetrically with respect to the center axis of the cap 4. The fitting part 14 is supported by the connecting parts 15 so that the disk shaped surface is vertical to the center axis of the cap 4. Further, the fitting part 14 is supported by the connecting parts 15 at its back end surface near the edge. As clear from FIG. 3, the connecting parts 15 do not extend along the center axis but extend slightly at a slant toward the center axis the further to the front. The cap body 4*a* has the vent opening and the two connecting parts 15 are spaced apart, so air can flow from the front end to the back end of the cap body 4*a*.

In this aspect, the cap body 4*a*, fitting part 14, and connecting parts 15 are integrally formed, but they may also be separately formed. Further, in this aspect, two connecting parts 15 were provided, but providing one or three or more is also possible. If there is a single connecting part 15, it is connected near the center of the surface which faces the fitting part 14. Further, if a vent opening 4*g* is not provided at the front end part 4*d* of the cap body 4*a*, the connecting part 15 is configured to extend from the front end part 4*d* of the cap body 4*a* toward the front.

The supporting wall 16 is a tubular member which is arranged around the fitting part 14 and connecting parts 15. The outer circumferential surface of the supporting wall 16 is formed on the same plane as the outer circumferential surface of the cap body 4*a*. In this aspect, the cap body 4*a* and the supporting wall 16 are integrally formed, but may also be separately formed. The supporting wall 16, as explained later, has an inner circumferential surface 16*a* into which an insert part 2*a* of the erasing member 2 is fit.

Figure 5:
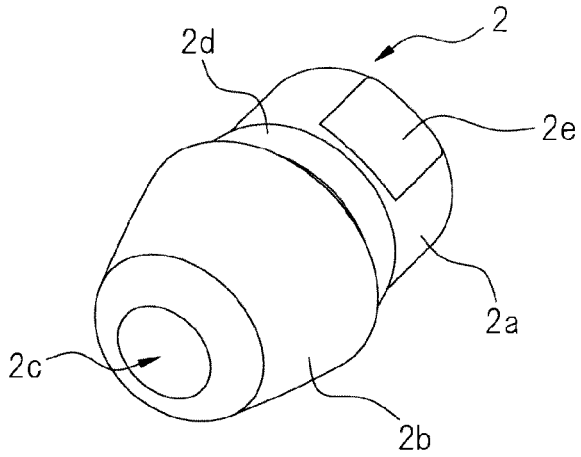
FIG. 5 is a perspective view of an erasing member of the writing instrument which is shown in FIG. 1.
Figure 6:
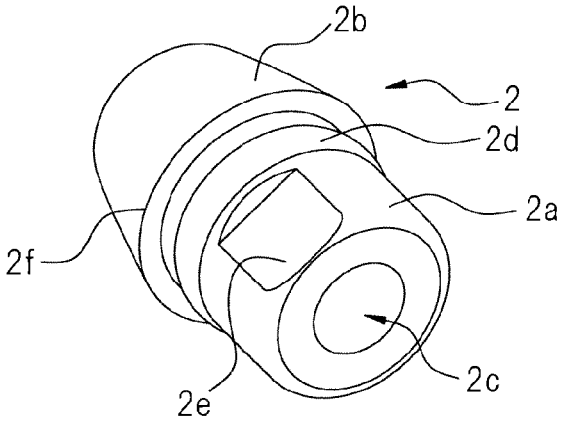
FIG. 6 is another perspective view of the erasing member of the writing instrument 1 which is shown in FIG. 1.
Figure 7:
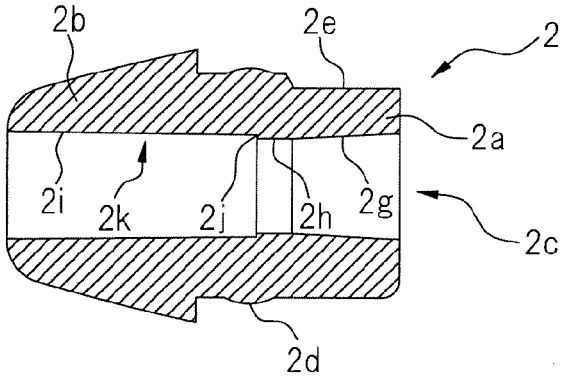
FIG. 7 is a vertical cross-sectional view of the erasing member which is shown in FIG. 5.

Next, while referring to FIG. 5 to FIG. 7, the structure of the erasing member 2 will be explained. FIG. 5 is a perspective view of the erasing member 2 of the writing instrument 1 which is shown in FIG. 1, FIG. 6 is another perspective view of the erasing member 2 of the writing instrument 1 which is shown in FIG. 1, and FIG. 7 is a vertical cross-sectional view of the erasing member 2 which is shown in FIG. 5.

The erasing member 2 has an insert part 2*a* which is inserted into and surrounded by the supporting wall 16 of the cap body 4*a*, an erasing part 2*b* which is exposed to the outside in the state where the erasing member 2 is attached to the cap and which is used for rubbing against a paper surface etc., and a fitting hole 2*c* which extends in the axial direction and passes through the insert part 2*a* and the erasing part 2*b*. The insert part 2*a* and the erasing part 2*b* may also be integrally formed. As the material which forms the erasing member 2, silicone rubber, nitrile rubber, ethylene-propylene rubber, ethylene-propylene-diene rubber, or other rubber material or a styrene-based elastomer, olefin-based elastomer, polyester-based elastomer, or other thermoplastic elastomer or other such rubbery material, a mixture of two or more types of elastic materials, a mixture of a rubbery material and a plastic, a commercially available eraser, etc. may be mentioned.

The insert part 2*a* is a substantially columnar shape which corresponds to the shape of the inner circumferential surface 16*a* of the supporting wall 16 of the cap body 4*a* and has at its side surface in the circumferential direction a ring shaped engagement projecting part 2*d*. The engagement projecting part 2*d* abuts against the inner circumferential surface 16*a* of the supporting wall 16 to be held so that the erasing member 2 does not become loose in the state attached to the cap 4. Note that, instead of the ring-shaped engagement projecting part 2*d*, a plurality of projections may also be formed in the circumferential direction. Further, if another means can be used to prevent the erasing member 2 from looseness, the engagement projecting part 2*d* need not be provided.

Further, at part of the side surface of the insert part 2*a*, a flat part 2*e* may be provided along the axial direction. When forming the erasing member 2 by injection molding, the part of the flat part 2*e* can be made the gate position at the time of molding. Due to this, even if gate residue is left on the flat part 2*e* after molding, since there is a clearance between the surface of the flat part 2*e* and the inner circumferential surface 16 of the supporting wall 16 of the cap body 4*a*, gate residue can be prevented from contacting the inner circumferential surface. Further, as explained later, by providing a corresponding projection at the inner circumferential surface 16*a* of the supporting wall 16, it becomes possible to position the erasing member 2 in a predetermined orientation at the time of attachment and possible to prevent the erasing member 2 from turning after attachment.

The erasing part 2*b* has a frustoconical shape which has a back end part which is large in diameter and which becomes smaller in diameter the further to the front end part. The front end face edge part of the erasing part 2*b* is chamfered round. Further, the back end face edge part of the erasing part 2*b* is larger in diameter than the insert part 2*a*. Therefore, a step-like flange part 2*f* is formed with the insert part 2*a*. When attaching the erasing member 2 to the cap, the back end face of the flange part 2*f* abuts against the front end face 16*b* of the supporting wall 16.

The fitting hole 2*c* extends in the axial direction and passes through the insert part 2*a* and the erasing part 2*b*. The fitting hole 2*c* receives the fitting part 14 and connecting parts 15 of the cap 4 when attaching the erasing member 2 to the cap 4. The fitting hole 2*c* is divided into a back end part into which the fitting part 14 is inserted, that is, an entrance part, then, in order, a taper part 2*g*, small diameter part 2*h*, and large diameter part 2*i*. The taper part 2*q* forms a taper shape which becomes narrower the more from the back end part of the fitting hole 2*c* toward the front, that is, which becomes narrower from the entrance part toward the deep part. The inside diameter of the front end of the taper part 2*g* and the inside diameter of the back end of the small diameter part 2*h* are set substantially equal. The boundary between the small diameter part 2*h* and the large diameter part 2*i* forms a step difference. As explained later, this forms a lock part 2*j* which prevents detachment of the fitting part 14. Note that, the small diameter part 2*h* may also be eliminated.

In this aspect, since the fitting hole 2*c* runs through the erasing member 2, even if the erasing member 2 detaches from the cap after shipment of the product and is mistakenly swallowed by an infant etc., it will not block the airway so safety can be secured.

Figure 8:
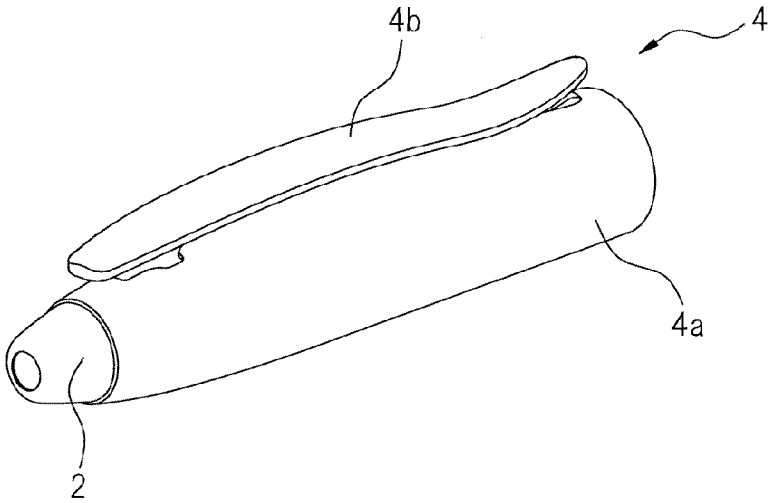
FIG. 8 is a perspective view of the cap to which the erasing member is attached in the writing instrument which is shown in FIG. 1.
Figure 9:
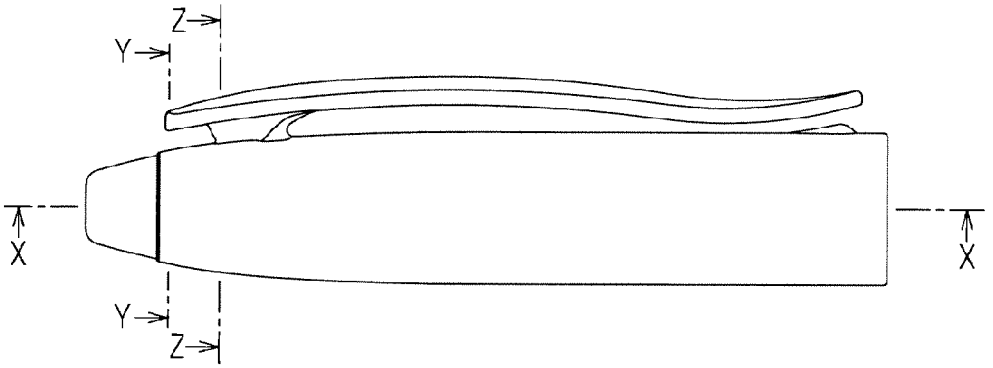
FIG. 9 is a side view of the cap which is shown in FIG. 8.
Figure 10:
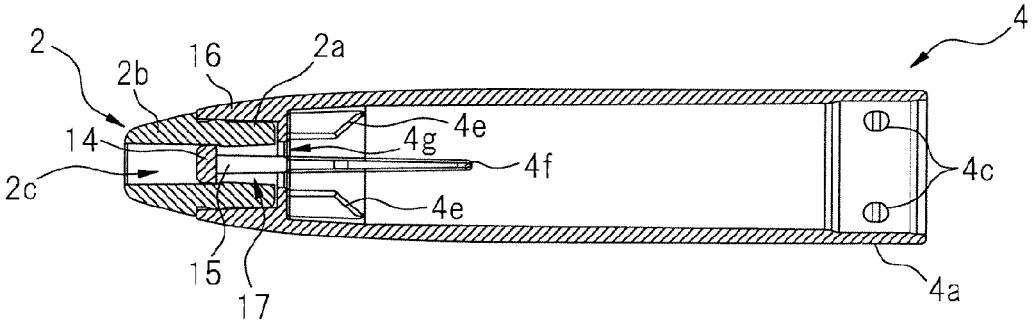
FIG. 10 is a vertical cross-sectional view along the line X-X of FIG. 9 of the cap which is shown in FIG. 8.
Figure 11:
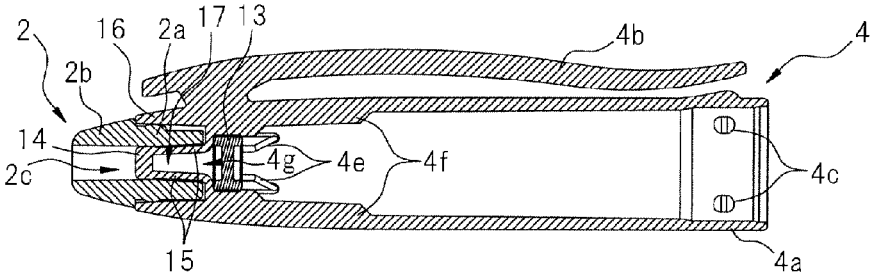
FIG. 11 is another vertical cross-sectional view of the cap which is shown in FIG. 8.
Figure 12:
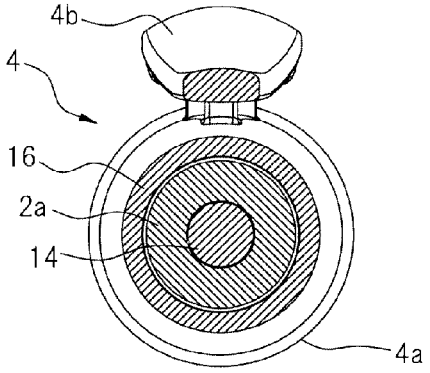
FIG. 12 is a horizontal cross-sectional view along the line Y-Y of FIG. 9 of the cap which is shown in FIG. 8.
Figure 13:
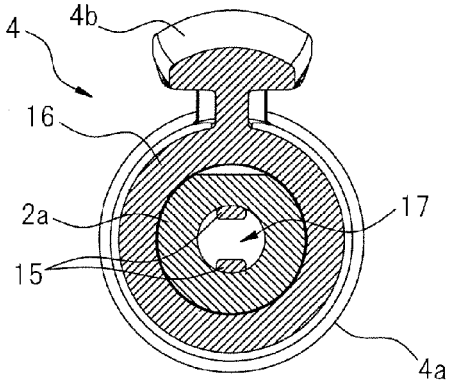
FIG. 13 is a horizontal cross-sectional view along the line Z-Z of FIG. 9 of the cap which is shown in FIG. 8.
Figure 14:
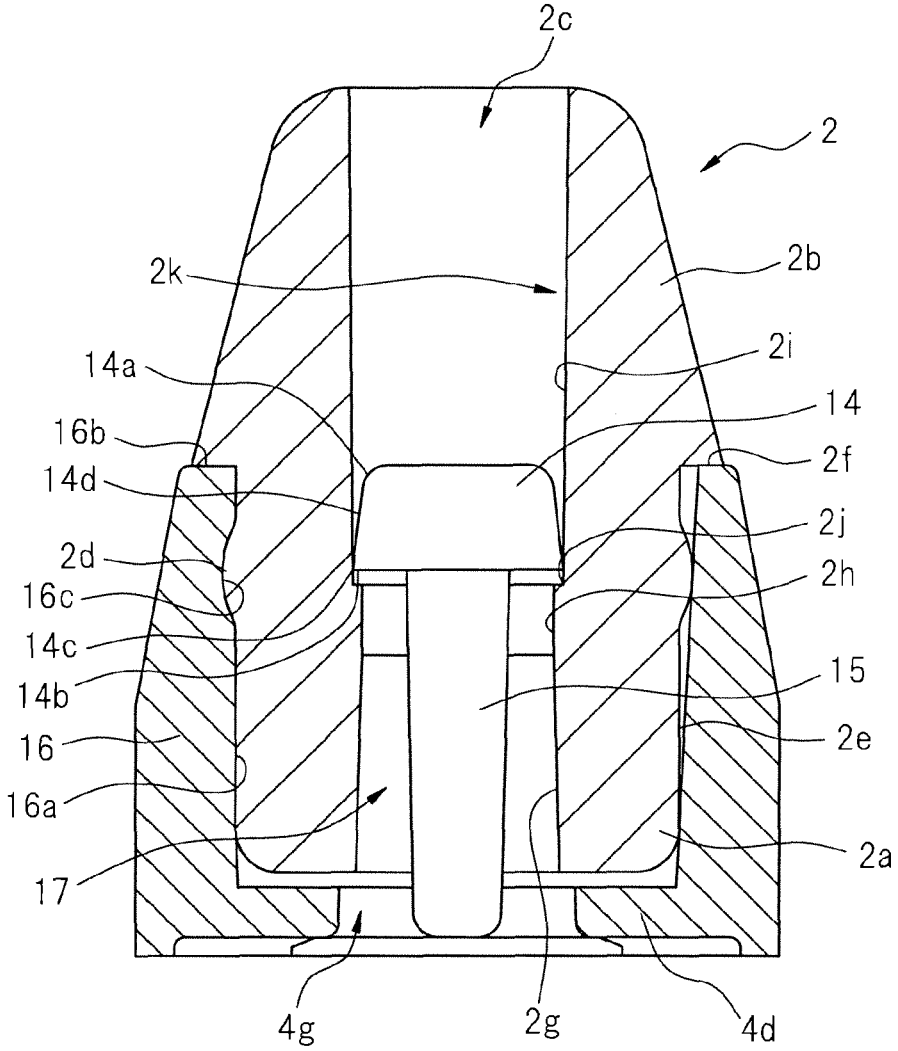
FIG. 14 is an enlarged cross-sectional view which shows the attachment part of the erasing member and the cap of the writing instrument which is shown in FIG. 1.

Next, while referring to FIG. 8 to FIG. 14, the attachment of the erasing member 2 and the cap 4 will be explained. FIG. 8 is a perspective view of the cap 4 to which the erasing member 2 is attached in the writing instrument 1 which is shown in FIG. 1, FIG. 9 is a side view of the cap 4 which is shown in FIG. 8, FIG. 10 is a vertical cross-sectional view along the line X-X of FIG. 9 of the cap 4 which is shown in FIG. 8, FIG. 11 is another vertical cross-sectional view of the cap 4 which is shown in FIG. 8, FIG. 12 is a horizontal cross-sectional view along the line Y-Y of FIG. 9 of the cap 4 which is shown in FIG. 8, FIG. 13 is a horizontal cross-sectional view along the line Z-Z of FIG. 9 of the cap 4 which is shown in FIG. 8, and FIG. 14 is an enlarged cross-sectional view which shows the attachment part of the erasing member 2 and the cap 4 of the writing instrument 1 which is shown in FIG. 1. FIG. 11 is a cross-sectional view at a position rotated 90 degrees about the center axis from the cross-sectional view which is shown in FIG. 10.

If inserting the erasing member 2 into the supporting wall 16 of the cap body 4*a*, the fitting part 14 is inserted into the fitting hole 2*c* of the erasing member 2 and the outer circumferential surface of the insert part 2*a* of the erasing member 2 is guided along the inner circumferential surface of the supporting wall 16. The fitting part 14 passes the taper part 2*g* and the small diameter part 2*h* of the fitting hole 2*c* to ride over the lock part 2*j*. When the back end face of the flange part 2*f* of the erasing member 2 abuts against the front end face 16*b* of the supporting wall 16, the attachment of the erasing member 2 is completed.

The maximum outside diameter of the fitting part 14 is set larger than the minimum inside diameter of the taper part 2*g* of the fitting hole 2*c*, that is, the inside diameter of the small diameter part 2*h*, and equal to or smaller than the inside diameter of the large diameter part 2*i*. Therefore, when the fitting part 14 passes the taper part 2*g* and the small diameter part 2*h* of the fitting hole 2*c*, the fitting part 14 or the insert part 2*a* of the erasing member 2 elastically deforms.

The front end face edge 14*a* of the fitting part 14 is chamfered round and the entrance part at the time of insertion into the fitting hole 2*c* forms a taper part 2*g*, so the fitting part 14 is smoothly inserted into the fitting hole 2*c*. Furthermore, during insertion of the fitting part 14 into the fitting hole 2*c*, inside the fitting hole 2*c*, only the outer circumferential surface 14*d* of the fitting part 14 contacts the inner circumferential surface 2*k* of the fitting hole 2*c* while moving. That is, the press-fitting force which is required for insertion is largely due to the frictional force between the outer circumferential surface 14*d* of the fitting part 14 and the inner circumferential surface 2*k* of the fitting hole 2*c*, but the contact area of these is substantially constant, so the press-fitting force which is required during insertion also is substantially constant. Therefore, the erasing member 2 can be easily attached to the cap.

Here, the inside diameters of the taper part 2*g* and the small diameter part 2*h* of the fitting hole 2*c* are set so that the two connecting parts 15 are held or abutted against in the state of completion of attachment. That is, the two connecting parts 15, as explained above, extend slanted toward the center axis the more toward the front, but this slant is set equal to or larger than the slant of the taper part 2*g* of the fitting hole 2*c*. Therefore, during attachment of the erasing member 2, the connecting parts 15 never abut against the inner circumferential surface 2*k* of the fitting hole 2*c*. On the other hand, by setting the slants of the two equal, at the time of completion of attachment, the two connecting parts 15 can be made to contact the inner circumferential surface of the taper part 2*g*. Due to this, there is no looseness of the erasing member 2 and strong attachment can be realized.

As clear from the relationship between the connecting parts 15 and the inner circumferential surface 2*k* of the fitting hole 2*c*, insertion so that the above-mentioned contact area becomes substantially constant is realized by the presence of the clearance space 17, which is formed due to the fitting part 14 being supported by the columnar connecting parts 15, around the connecting parts 15. The clearance space 17 is defined by the fitting part 14, the connecting parts 15, and the inner circumferential surface 2*k* of the fitting hole 2*c* of the erasing member 2. Due to the presence of the clearance space 17, it becomes possible to reduce the frictional resistance during attachment of the erasing member 2 to the cap and enable easy attachment.

In the state where attachment is completed, the fitting part 14 is just slightly separated in the axial direction from the step-shaped lock part 2*j* which is provided inside the fitting hole 2*c* of the erasing member 2. Further, the back end face of the insert part 2*a* of the erasing member 2 as well similarly is separated just slightly in the axial direction from the front end part 4*d* of the cap body 4*a*. The engagement projecting part 2*d* which is provided at the side surface of the insert part 2*a* of the erasing member 2 elastically deforms, whereby it engages with the inner circumferential surface 16*a* of the supporting wall 16 and makes it difficult for the erasing member 2 to detach. Furthermore, to make the engagement projecting part 2*d* and the inner circumferential surface 16*a* of the supporting wall 16 engage more reliably, the inner circumferential surface of the supporting wall 16 at the position corresponding to the engagement projecting part 2*d* after completion of attachment may be provided with a recessed part 16*c* of a shape which corresponds to the engagement projecting part.

In the state where attachment is completed, the elastic deformation of the fitting part 14 or the insert part 2*a* of the erasing member 2 at the time of attachment is reversed. For this reason, if trying to pull out the erasing member 2 from the cap 4 for the purpose of changing the erasing member 2 etc., the front end face of the lock part 2*j* of the erasing member 2 and the corner part 14*c* of the back end face of the fitting part 14 engage and impair this. Therefore, to pull out the erasing member 2 from the cap 4, a stronger force must be applied. Due to this, the lock part 2*j* or the corner part 14*c* elastically deforms whereby the fitting is released and the erasing member 2 can be pulled out from the cap 4.

The pullout force which is required for pulling out the erasing member 2 from the cap 4 is preferably designed to be larger than the press-fitting force which is required for attaching the erasing member 2 to the cap 4. This can be realized by, for example, adjusting the slant or the minimum inside diameter of the taper part 2*g* of the fitting hole 2*c* or by adjusting the maximum outside diameter of the fitting part 14 etc.

Note that, the fitting hole 2*c* of the erasing member 2 may be designed to have only the taper part 2*g* and not have the small diameter part 2*h* and the large diameter part 2*i*, that is, not have the lock part 2*j*. In this case, the fitting part 14 is engaged by the frictional resistance between its outer circumferential surface 14*d* and the inner circumferential surface of the taper part 2*g* of the fitting hole 2*c*.

Here, the writing instrument 1 according to the aspect of the present invention which was shown in FIG. 1 uses ink constituted by thermochromic ink. "Thermochromic ink" means ink which has the property of maintaining a predetermined color (first color) at ordinary temperature (for example, 25° C.), changing to another color (second color) if raised to a predetermined temperature (for example, 60° C.), then returning again to the original color (first color) if made to cool to a predetermined temperature (for example, −5° C.). In a writing instrument 1 which uses a thermochromic ink, making the above second color colorless and making a line which is written by the first color (for example, red) rise in temperature to make it colorless is referred to here as "erasure". Therefore, in the present aspect, the paper surface etc. on which a line is drawn is rubbed by the erasing member 2 to generate heat of friction and thereby change the line to a colorless one, that is, erase it. Note that, only naturally, the above second color may be made any color other than being made colorless.

The "erasure" in the present invention means, in addition to the case of use of the above thermochromic ink, absorbing or rubbing off a drawn line, letter, etc. by an eraser or other erasing member 2. Therefore, the above aspect and following aspects of the present invention can be applied to any writing instrument which uses an erasing member 2 for erasure.

Below, a writing instrument according to another aspect of the present invention will be explained. The writing instrument body is similar to the one of the above-mentioned aspect, so explanation of it will be omitted. Only the points which differ from the above aspect will be explained.

Figure 15:
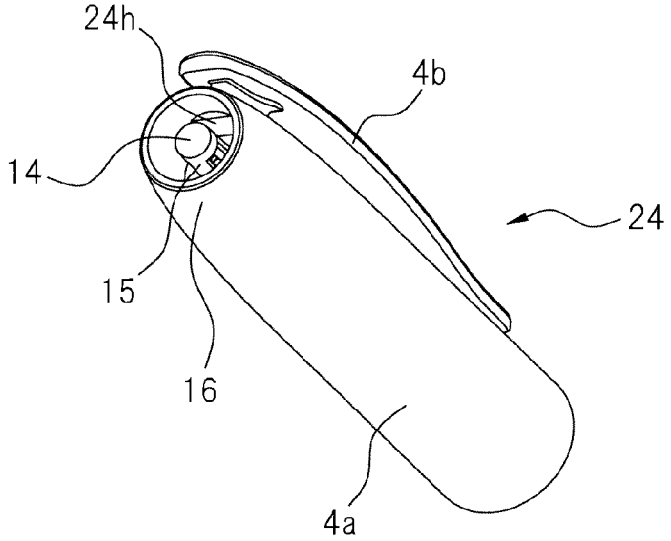
FIG. 15 is a perspective view of a cap of another aspect different from the cap of the writing instrument which is shown in FIG. 1.
Figure 16:
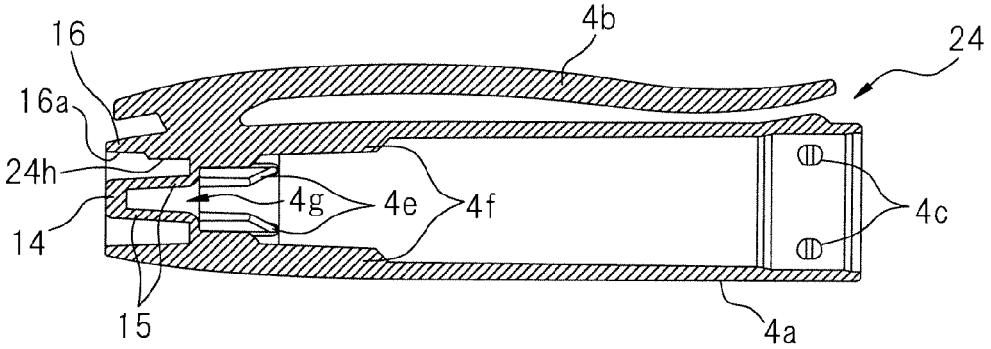
FIG. 16 is a vertical cross-sectional view of the cap which is shown in FIG. 15.

FIG. 15 is a perspective view of the cap 24 of another aspect different from the cap 4 of the writing instrument which is shown in FIG. 1, while FIG. 16 is a vertical cross-sectional view of the cap 24 which is shown in FIG. 15. The cap 24 which is shown in FIG. 15 and FIG. 16 differs from the cap 4 which is shown in FIG. 2 to FIG. 4 only on the point of having a positioning projection 24*h*. The positioning projection 24*h* has a complementary shape to the flat part 2*e* which is provided at the insert part 2*a* of the erasing member 2 in the state where the erasing member 2 is attached to the cap 24. By the cap 24 having the positioning projection 24*h*, it becomes possible to position the erasing member 2 with a predetermined orientation at the time of attachment, and, after attachment, possible to prevent rotation of the erasing member 2. If the cap 24 is formed from a transparent or semitransparent material, the positioning projection 24*h* is preferably provided at the side with the clip part 4*b* at the inner circumferential surface 16*a* of the supporting wall 16 so as to give rise to an aesthetic feeling in relationship to the alignment with the clip part 4*b*.

Figure 17:
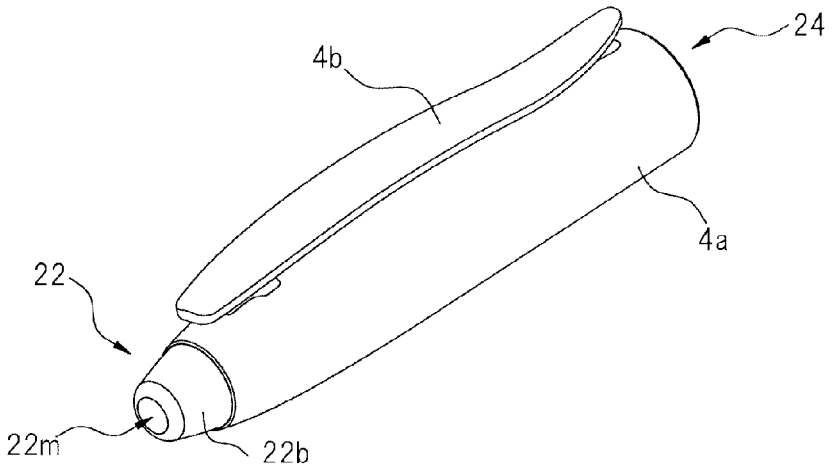
FIG. 17 is a perspective view of the cap to which is attached an erasing member of another aspect from the erasing member of the writing instrument which is shown in FIG. 1.
Figure 18:
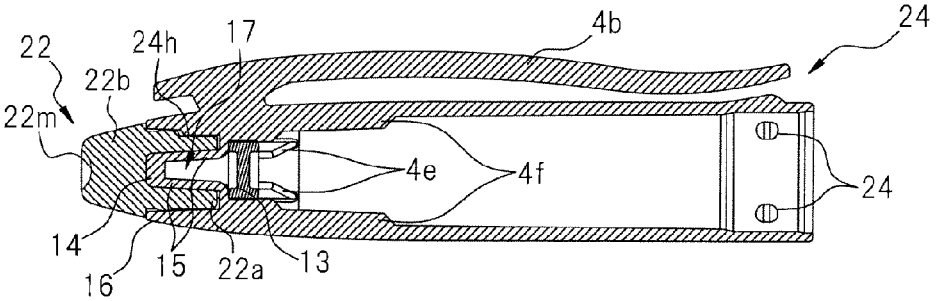
FIG. 18 is a vertical cross-sectional view of the cap which is shown in FIG. 17.
Figure 19:
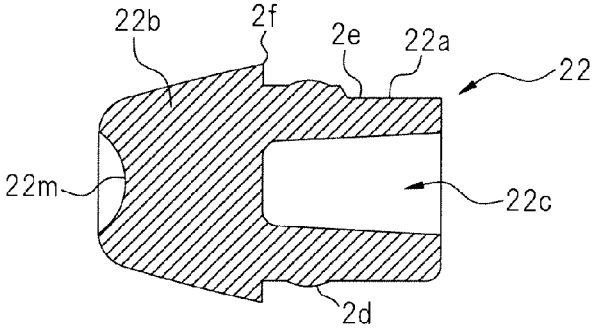
FIG. 19 is a vertical cross-sectional view of the erasing member which is shown in FIG. 17.

FIG. 17 is a perspective view of the cap 24 to which is attached an erasing member 22 of another aspect from the erasing member 2 of the writing instrument which is shown in FIG. 1, FIG. 10 is a vertical cross-sectional view of the cap 24 which is shown in FIG. 17, and FIG. 19 is a vertical cross-sectional view of the erasing member 22 which is shown in FIG. 17.

In this aspect, the cap 24 is the one which is shown in FIG. 15 and FIG. 16. The erasing member 22 differs from the erasing member 2 which is shown in FIG. 5 to FIG. 7 only on the point that the fitting hole 22*c* does not run up through the erasing part 22*b*. That is, the fitting hole 22*c* is drawn simplified in the drawings, but the insert part 22*a* has at least a taper part, lock part, and large diameter part. The axial direction length of the large diameter part is set to a length for receiving the fitting part 14 and connecting parts 15 of the cap. Note that, as explained above, the fitting hole 22*c* may also be designed having just a taper part.

The front end face of the erasing part 22*b* is provided with a recessed part 22*m* of a recessed curved shape. By having the front end face of the erasing part 22*b* be provided with the recessed part 22*m*, erasure of fine locations using the edges of the recessed part 22*m* becomes possible. Further, by placing the erasing member 22 at right angle to the paper surface etc. on which a line is drawn and performing an erasing operation, compared with the case where the front end face of the erasing pare is formed into a projecting curved shape, the frictional resistance is reduced and smooth broad range erasure becomes possible.

Figure 20:
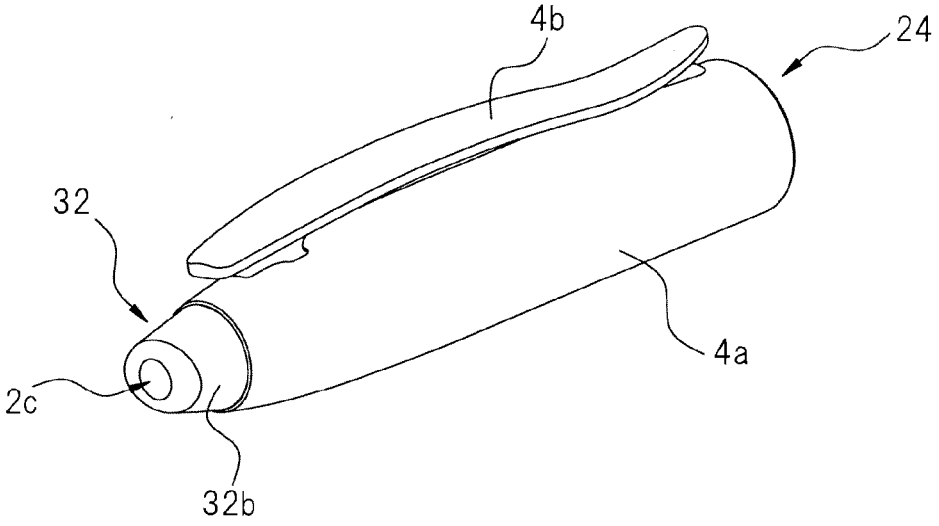
FIG. 20 is a perspective view of the cap to which is attached an erasing member of still another aspect from the erasing member of the writing instrument which is shown in FIG. 1.
Figure 21:
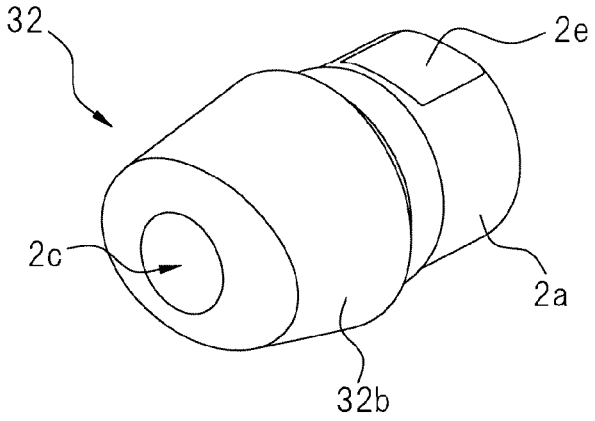
FIG. 21 is a perspective view of the erasing member which is shown in FIG. 20.
Figure 22:
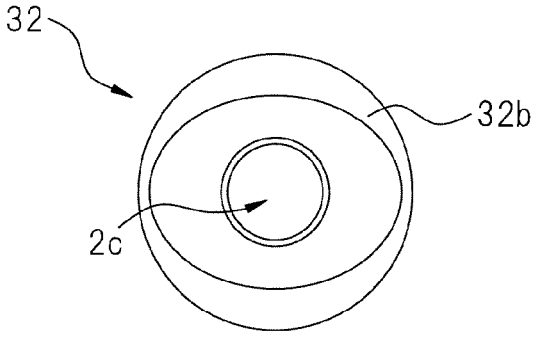
FIG. 22 is a front view of the erasing member which is shown in FIG. 20.

FIG. 20 is a perspective view of the cap 24 to which is attached an erasing member 32 of still another aspect from the erasing member 2 of the writing instrument which is shown in FIG. 1, FIG. 21 is a perspective view of the erasing member 32 which is shown in FIG. 20, and FIG. 22 is a front view of the erasing member 32 which is shown in FIG. 20.

In this aspect, the cap 24 is one which is shown in FIG. 15 and FIG. 16. The erasing member 32, compared with the erasing member 2 which is shown in FIG. 5 to FIG. 7, is the same in the insert part 2*a* and fitting hole 2*c* and only differs in the outer shape of the erasing part 32*b*. The erasing part 32*b* has an outer shape which has a horizontal cross-sectional shape which is circular at the back end face, but changes to an elliptical shape with a ratio of the long axis and short axis which gradually becomes larger from the back end face toward the front end face. The length of the long axis of the elliptical shape at the front end face of the erasing part 32*b* is shorter than the diameter of the circle of the back end face of the erasing part 32*b*. By making the horizontal cross-sectional shape of the erasing part 32*b* an elliptical shape, at the time of erasure of a line etc., it is possible to make the long axis direction parallel to the paper surface etc. or make the short axis direction parallel to the paper surface etc. or to make it intermediate between them so as to realize different erasure widths, that is, areas which can be rubbed at one time.

Figure 23:
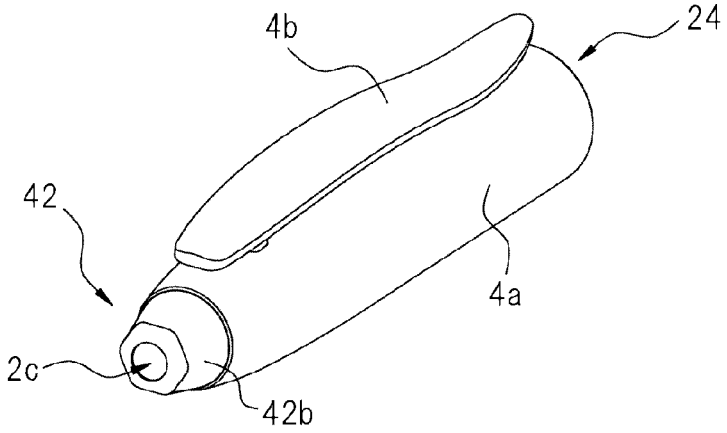
FIG. 23 is a perspective view of the cap to which is attached an erasing member of still another aspect from the erasing member of the writing instrument which is shown in FIG. 1.
Figure 24:
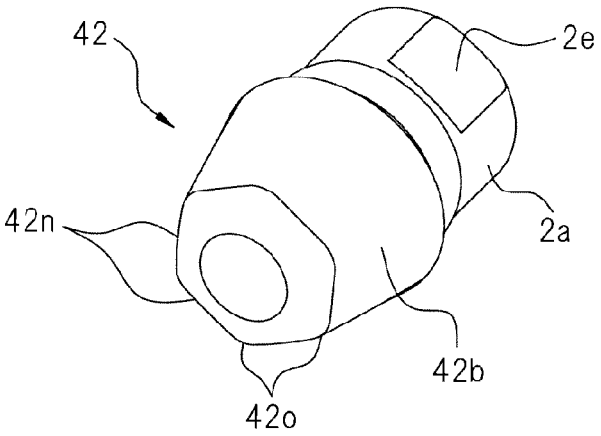
FIG. 24 is a perspective view of the erasing member which is shown in FIG. 23.
Figure 25:
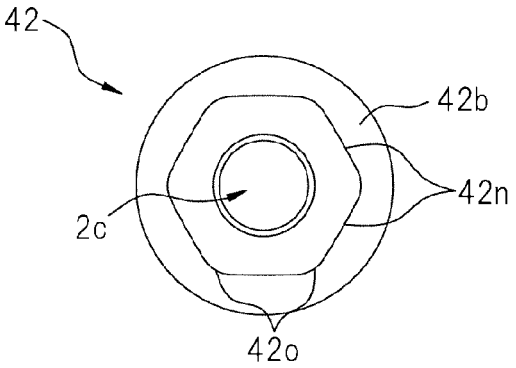
FIG. 25 is a front view of the erasing member which is shown in FIG. 23.

FIG. 23 is a perspective view of the cap 24 to which is attached an erasing member 42 of still another aspect from the erasing member 2 of the writing instrument which is shown in FIG. 1, FIG. 24 is a perspective view of the erasing member 42 which is shown in FIG. 23, and FIG. 25 is a front view of the erasing member 42 which is shown in FIG. 23.

In this aspect, the cap 24 is the one which is shown in FIG. 15 and FIG. 16. The erasing member 42, compared with the erasing member 2 which is shown in FIG. 5 to FIG. 7, is the same in the insert part 2*a* and fitting hole 2*c* and only differs in the outer shape of the erasing part 42*b*. The erasing part 42*b* has a horizontal cross-sectional shape which is circular at the back end face, but is hexagonal at the front end face. It has a shape which gradually changes from a circular shape to a hexagonal shape from the back end face to the front end face. The hexagonal shape of the front end face of the erasing part 42*b* is chamfered round at the corners. Preferably, one side of the hexagonal shape becomes parallel with the flat part 2*e* of the insert part 2*a*. By the front end face of the erasing part 2*b* having a hexagonal shape, it becomes possible to utilize the side parts 42*n* and the corner parts 42*o* to erase small locations. Note that, the shape of the front end face of the erasing part 42*b* is not limited to a hexagonal shape and may also be a triangular shape, square shape, or other polygonal shape.

Figure 26:
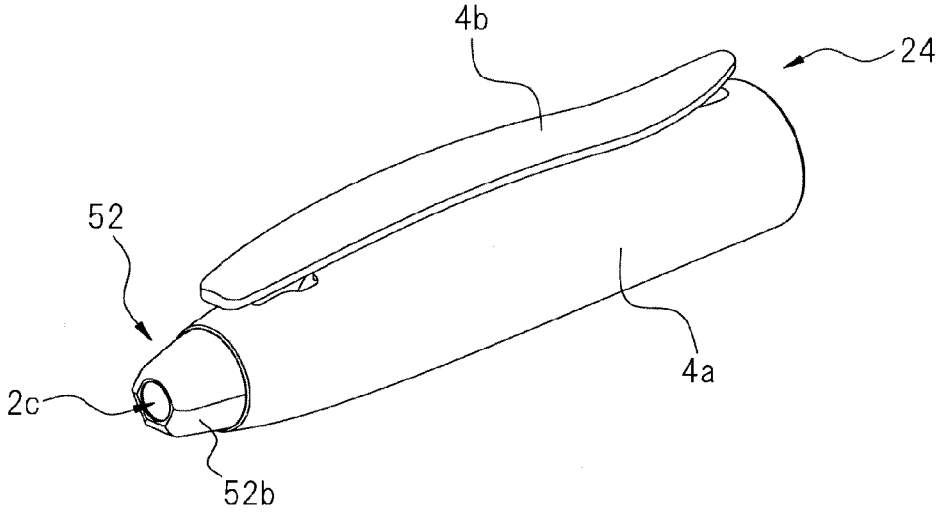
FIG. 26 is a perspective view of the cap to which is attached an erasing member of still further another aspect from the erasing member of the writing instrument which is shown in FIG. 1.
Figure 27:
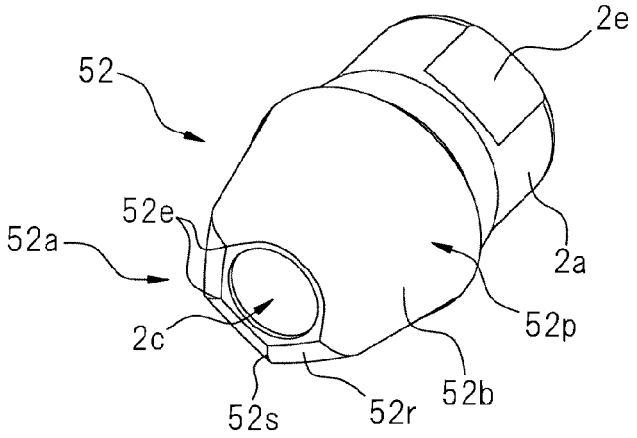
FIG. 27 is a perspective view of the erasing member which is shown in FIG. 26.
Figure 28:
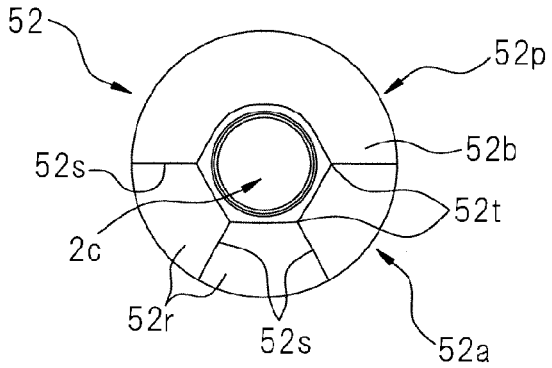
FIG. 28 is a front view of the erasing member which is shown in FIG. 26.

FIG. 26 is a perspective view of the cap 24 to which is attached an erasing member 52 of still further another aspect from the erasing member 2 of the writing instrument which is shown in FIG. 1, FIG. 27 is a perspective view of the erasing member 52 which is shown in FIG. 26, and FIG. 28 is a front view of the erasing member 52 which is shown in FIG. 26.

In this aspect, the cap 24 is one which is shown in FIG. 15 and FIG. 16. The erasing member 52, compared with the erasing member 2 which is shown in FIG. 5 to FIG. 7, is the same in the insert part 2*a* and fitting hole 2*c* and only differs in the cuter shape of the erasing part 52*b*. The erasing part 52*b*, if considering it split into halves in the vertical direction, has a first half 52*p* which has a frustoconical shape and has a second half 52*q* which has a hexagonal frustoconical shape. The first half is positioned at the clip part 4*b* side of the cap 24 by having the flat part 2*c* which is positioned by the positioning projection 24*h* of the cap body 4*a* be provided at the first half 52*p* side of the insert part 2*a*.

By arranging the first half 52*p* at the clip part 4*b* side of the cap, the hexagonal frustoconical shape surface of the second half 52*q* becomes easier to use. That is, usually, when a user holds the cap 24 to perform an erasing operation, he or she places his or her forefinger and thumb at the outer circumferential surface of the cap body 4*a* while avoiding the clip part 4*b* and places his or her middle finger at part of the outer circumferential surface of the cap body 4*a* at the side opposite to the side with the clip part 4*b* so as to thereby grip the cap 24. Therefore, in this gripped state, the surface of the hexagonal frustoconical shape of the second half 52*q* faces the paper surface.

The first half 52*p* is the same shape as the erasing part 2*b* which is shown from FIG. 5 to FIG. 7. The second half 52*q* is half of a hexagonal frustoconical shape, so has three flat parts 52*r*. Therefore, the first half 52*p* part of the erasing part 52*b* can be used for erasure so as to erase a narrow surface. On the other hand, when using the second half 52*q* part of the erasing part 52*b* for erasure, by using the different flat parts 52*r*, it becomes possible to erase an area broader than the case of using the first half 52*p*. Further, the connecting parts of the flat parts, that is, the peak parts 52*s*, or the connecting parts 52*t* of the peak parts and the front end face can be used to erase finer locations.

Figure 29:
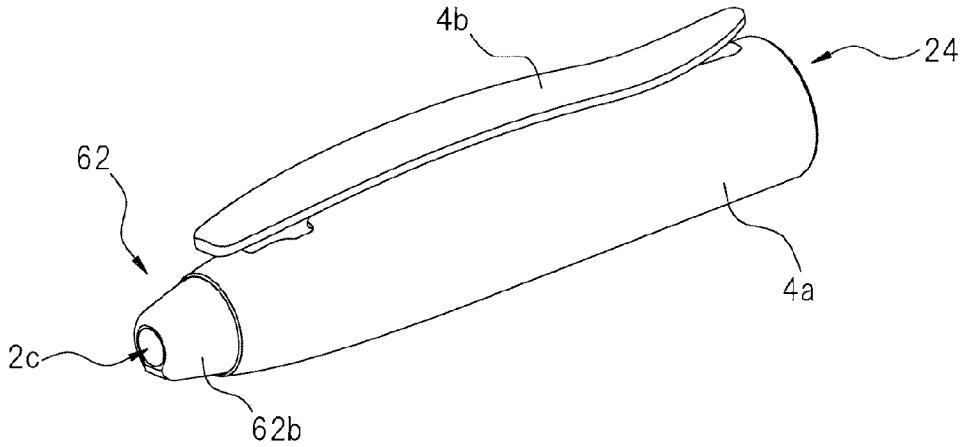
FIG. 29 is a perspective view of the cap to which is attached an erasing member of still another aspect from the erasing member of the writing instrument which is shown in FIG. 1.
Figure 30:
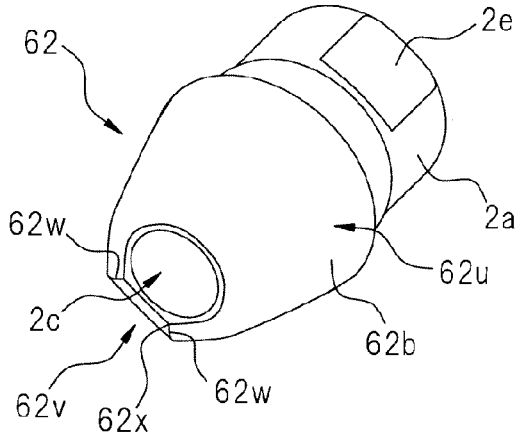
FIG. 30 is a perspective view of the erasing member which is shown in FIG. 29.
Figure 31:
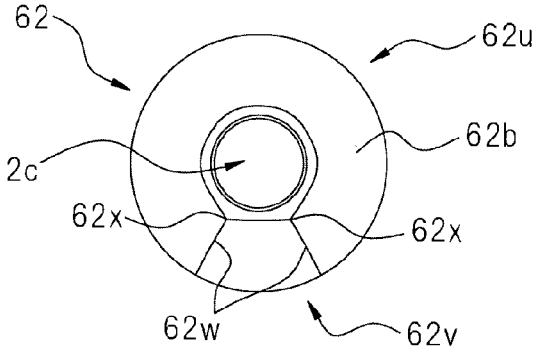
FIG. 31 is a front view of the erasing member which is shown in FIG. 29.

FIG. 29 is a perspective view of the cap 25 to which is attached an erasing member 62 of still another aspect from the erasing member 2 of the writing instrument which is shown in FIG. 1, FIG. 30 is a perspective view of the erasing member 62 which is shown in FIG. 29, and FIG. 31 is a front view of the erasing member 62 which is shown in FIG. 29.

In this aspect, the cap 24 is the one which is shown in FIG. 15 and FIG. 16. The erasing member 62, compared with the erasing member 2 which is shown in FIG. 5 to FIG. 7 is the same in the insert part 2*a* and fitting hole 2*c* and only differs in the outer shape of the erasing part 62*b*. The erasing part 62*b* is configured as the second half 52*q* part which is shown in FIG. 26 to FIG. 28 where the two side surfaces are replaced with the frustoconical shape of the first half 52*p*. Therefore, the erasing part 62*b* is comprised of a frustoconical shape part 62*u* and a hexagonal frustoconical shape part 62*v*. The frustoconical shape part 62*u* is made to be arranged at the clip part 4*b* side of the cap 24 by having the flat part 2*e* which is positioned by the positioning projection 24*h* of the cap body 4*a* be provided at the frustoconical shape part 62*u* side of the insert part 2*a*.

By arranging the frustoconical shape part 62*u* at the clip part 4*b* side of the cap 24, the surface of the hexagonal frustoconical shape part 62*v* becomes easier to use. That is, usually, when the user holds the cap 24 to perform an erasing operation, he or she places his or her forefinger and thumb at the outer circumferential surface of the cap body 4*a* while avoiding the clip part 4*b* and places his or her middle finger at part of the outer circumferential surface of the cap body 4*a* at the side opposite to the side with the clip part 4*b* so as to thereby grip the cap 24. Therefore, in this gripped state, the surface of the hexagonal frustoconical shape part 62*v* faces the paper surface.

By using the frustoconical shape part 62*u* of the erasing part 62*b* for erasure, erasure at a narrow surface becomes possible. On the other hand, when using the hexagonal frustoconical shape part 62*v* of the erasing part 62*b* for erasure, a single surface is used, so erasure of a wider surface than when using the frustoconical shape part 62*u* becomes possible. Further, by using the connecting parts of the surfaces, that is, the peak parts 62*w*, or the connecting parts 62*x* of the peak parts 62*w* and the front end face, erasure of finer locations becomes possible.

The above aspect of the erasing member of the present invention was one where the erasing member was attached to the front end part of the cap, but it may be similarly applied even at the back end part of the writing instrument body.

Figure 32:
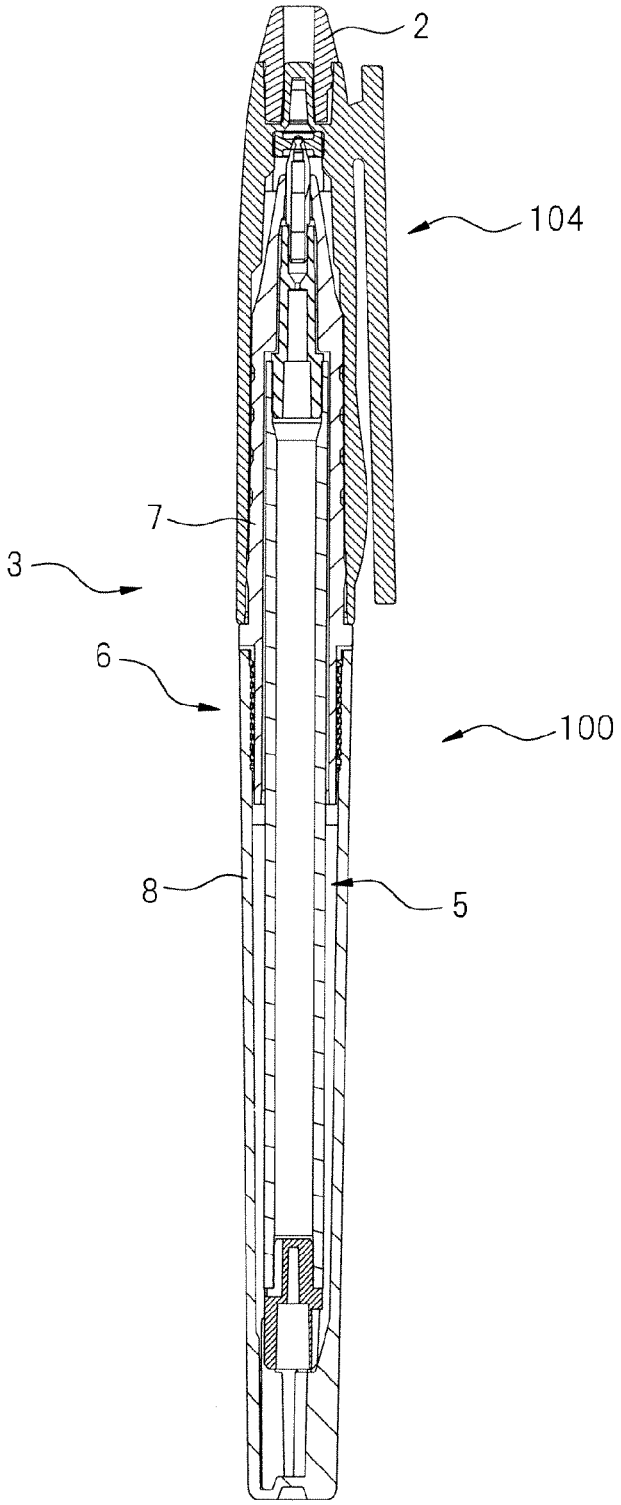
FIG. 32 is a vertical cross-sectional view of a writing instrument according to a second embodiment which is provided with an erasing member according to an aspect of the present invention.

FIG. 32 is a vertical cross-sectional view of the writing instrument 100 according to the second embodiment which is provided with the erasing member 2 according to one aspect of the present invention. The writing instrument 1 is a ball pen type of writing instrument and has a writing instrument body 3, which is provided with a refill 5 and a cylinder 6 which extends in a tubular shape, and a cap 104. The cylinder 6 has a tubular front cylinder 7 and a back cylinder 8 with a front end part which screws into the hack end part of the front cylinder 7. The writing instrument 100 according to the present embodiment differs from the above-mentioned writing instrument 1 according to the first embodiment only in the outer shape of the cap, in particular the shape of the clip part. Therefore, the following explanation will be given particularly regarding the clip part, while the explanation of the other parts will be omitted. Note that, the cap 104 can, for example, be designed to enable attachment of the erasing member which is attached to the cap 4 which is shown in FIG. 4. For example, it can be designed to enable attachment of the erasing member which is attached to the cap 24 which is shown in FIG. 15.

Figure 33:
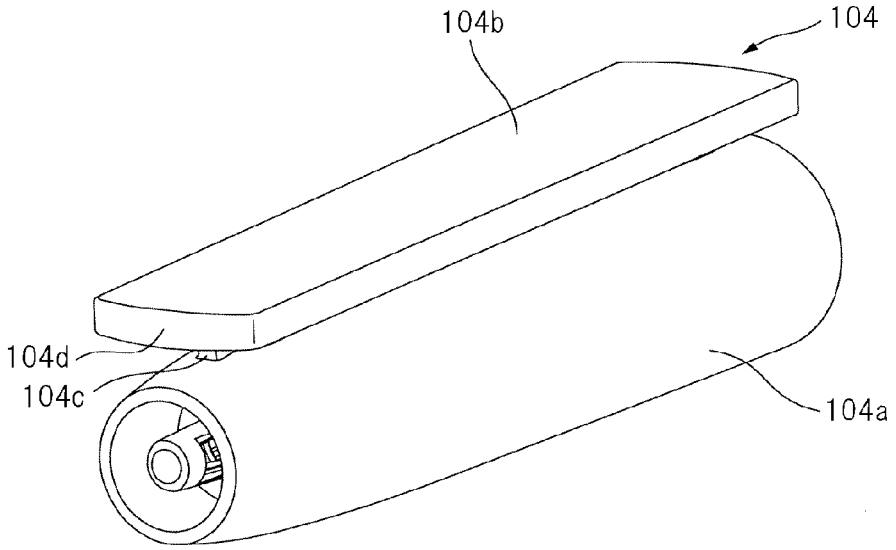
FIG. 33 is a perspective view of the cap of the writing instrument which is shown in FIG. 32.
Figure 34:
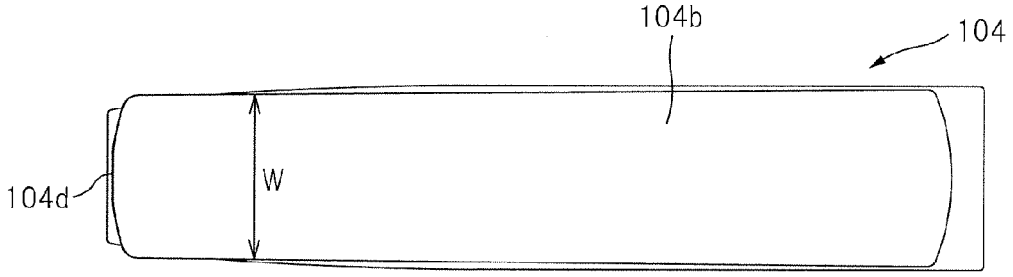
FIG. 34 is a plan view of the cap which is shown in FIG. 33.
Figure 35:
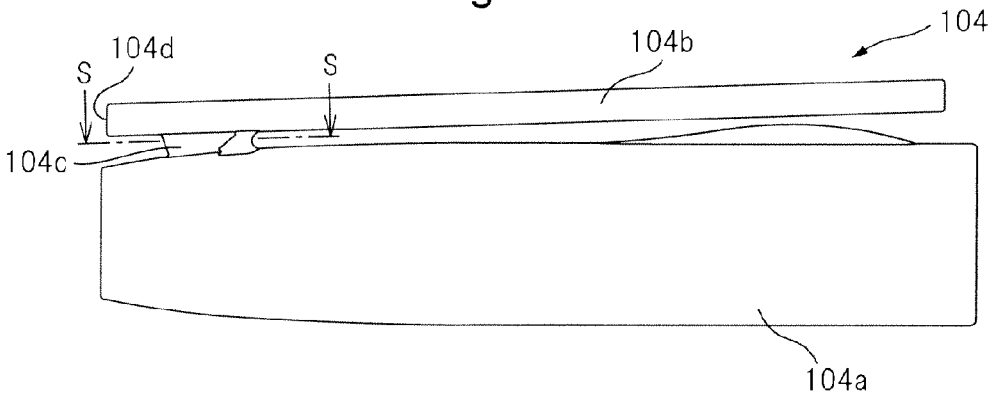
FIG. 35 is a side view of the cap which is shown in FIG. 33.
Figure 36:
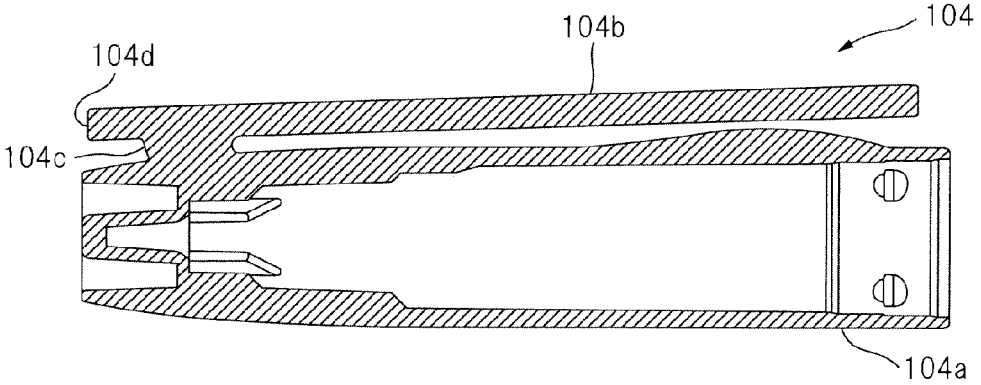
FIG. 36 is a vertical cross-sectional view of the cap which is shown in FIG. 33.
Figure 37:
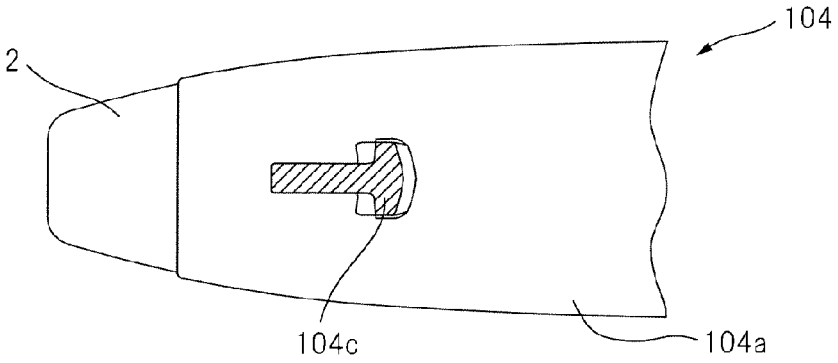
FIG. 37 is a cross-sectional view along the line S-S of FIG. 35 of the cap which is shown in FIG. 33.

FIG. 33 is a perspective view of the cap 104 of the writing instrument 100 which is shown in FIG. 32, FIG. 34 is a plan view of the cap 104 which is shown in FIG. 33, FIG. 35 is a side view of the cap 104 which is shown in FIG. 33, FIG. 36 is a vertical cross-sectional view of the cap 104 which is shown in FIG. 33, and FIG. 37 is a cross-sectional view along the line S-S of FIG. 35 of the cap 104 which is shown in FIG. 33.

The cap 104 has a cap body 104*a*, clip part 104*b*, and, in the present embodiment, erasing member 2. The cap body 104*a* is a tubular member. At its side surface, the clip part 104*b* is provided integrally via a connecting part 104*c*. The clip part 104*b* is designed to have elasticity so as to be able to grip a document, clothing, or other object with the cap body 104*a*. Therefore, as the material which forms the cap body 104*a* and the clip part 104*b*, polycarbonate, acrylonitrile-butadiene-styrene, or other plastic may be mentioned. As explained above, these parts are preferably formed by a material which is harder than the front cylinder 7.

The characterizing feature of the cap 104 is the substantially rectangular shape plate-shaped member where the clip part 104*b* extends over substantially the entire length of the clip body 104*a* in the axial direction. The back end face of the clip part 104*b*, as shown in FIG. 34, is formed in a curved shape to improve the hand feeling. Further, at the center part of the front end face of the clip part 104*b*, a flat surface which is vertical to the center axis, that is, a guide surface 104*d*, is formed. The front end face at the two sides of this is formed in a curved shape similar to the back end face. The edges of the clip part 104*b* are chamfered. Note that, the guide surface 104*d* need not be vertical to the center axis. For example, as explained later while referring to FIG. 38, it may also be a slanted surface matched with the facing paper surface at the time of erasure.

The width W of the clip part 104*b*, as clear from the plan view of FIG. 34, is substantially the same as the diameter of the tubular cap body 104*a*. Therefore, from the viewpoint of the user, the cap body 104*a* is almost completely hidden by the clip part 104*b* and so only the clip part 104*b* and the erasing member 2 are visible. That is, compared with a conventional clip part, for example, the clip part 4*b* of the cap 4 which is shown in FIG. 2, the clip part 104*b* of the cap 104 has a wide width and a broad range and smooth surface. Therefore, it is possible to decorate the surface with transfer printing etc. to thereby make the design fancier and improve the appeal to the user. Further, by attaching rubber, an elastomer, or other rubbery material to the surface, an erasing surface which is wider than the erasing member 2 is formed, so it becomes possible to selectively use the areas for erasure.

The connecting part 104*c* which connects the cap body 104*a* and the clip part 104*b*, as shown in FIG. 37, has a T-shaped horizontal cross-sectional shape. For this reason, the strength of the clip part 104*b* with respect to the force in the circumferential direction (up-down force in FIG. 37) is increased. Therefore, at the time of use by the user etc., breakage of the connecting part 104*c* is prevented even when force in the circumferential direction is applied to the clip part 104*b*.

Figure 38:
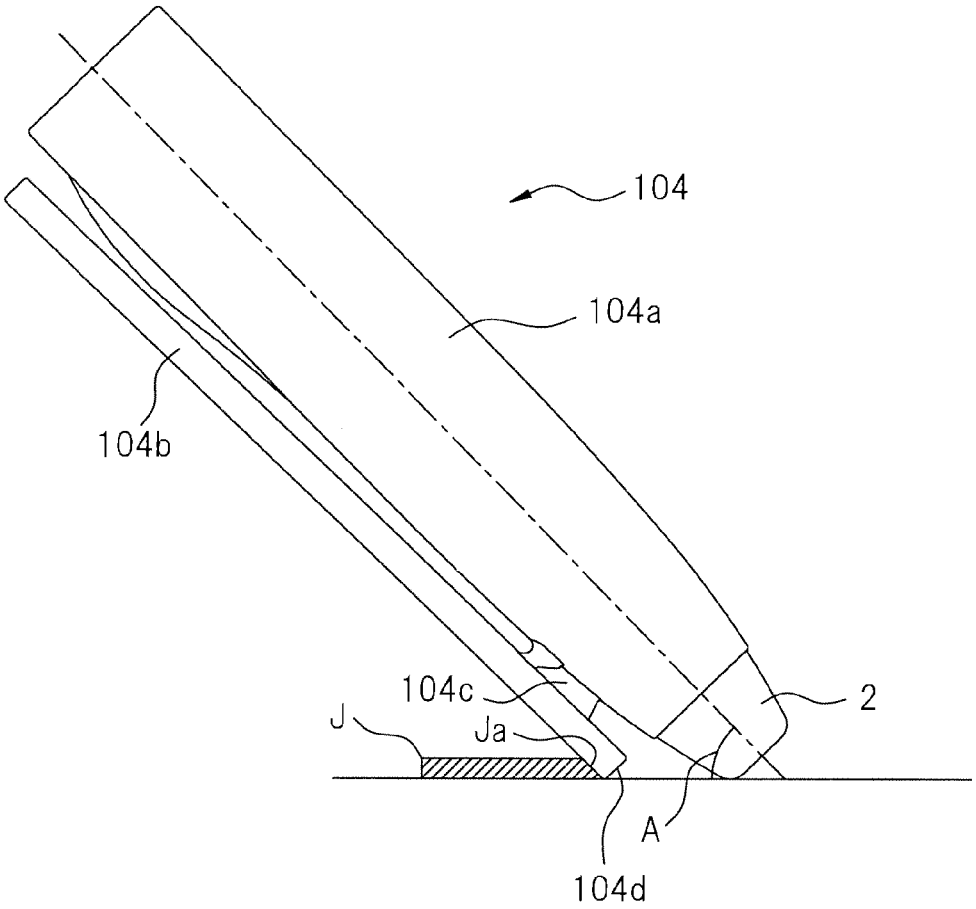
FIG. 38 is a view which shows the state of use of the cap to which is attached the erasing member of the writing instrument which is shown in FIG. 32 at the time of erasure by the cap.

FIG. 38 is a view which shows the state of use at the time of erasure by the cap 104 to which an erasing member 2 is attached in the writing instrument which is shown in FIG. 32. As shown in FIG. 38, at the time of erasure, the flat guide surface 104*d* of the clip part 104*b* can be pushed against the paper surface while making the cap 104 slide along the guide surface 104*d* so as to enable a constant width of writing to be erased. At this time, if pressing the guide surface 104*c* of the clip part 104*b* by a ruler or other guide member while making the cap 104 slide, a more stable erasure operation becomes possible and, further, constant width, long range erasure becomes possible. Further, by pressing the guide surface 104*d* of the clip part 104*b* against the paper surface and making the wide width surface of the clip part 104*b* abut against a slanted surface Ja which is provided at the ruler J while sliding the cap 104, a further stabler erasure operation becomes possible.

Further, the shape of the erasing member 2 or the axial direction position of the clip part 104*b* with respect to the cap body 104*a*, the shape of the guide surface 104*d*, etc. can be adjusted to adjust the angle A which is formed by paper surface and the center axis of the writing instrument 100 at the time of the erasure operation. This angle A is preferably a range of 40 to 80 degrees.

In addition to the above-mentioned effect, since the width W of the clip part 104*b* and the diameter of the cap body 104*a* are substantially the same, for example, when turning the wide width flat surface of the clip part 104*b* upward and placing the writing instrument 100 on a desktop etc., the writing instrument 100 turns so that the side surface of the clip part 104*b* contacts the desktop etc. and therefore the writing instrument 100 can be kept in a true horizontal state. Therefore, the effect is exhibited that the cylinder 6 can be easily gripped when picking up the writing instrument 100. Further, it is possible to prevent the writing instrument 100 from rolling around.

Furthermore, by extending the clip part 104*b* up to the center of gravity position of the writing instrument and having the cap 104 have the clip part 104*b* of the above-mentioned structure, for example, when placing the writing instrument 100 on a desktop while arranging the wide width flat surface of the clip part 104*b* down, the back end part of the writing instrument 100 does not contact the desktop and can be kept stable in a floating state. Therefore, when picking up the writing instrument 100, the effect is exhibited that the cylinder 6 is easy to grip. Further, the clip part 104*b* as a whole is wide in width, so without touching the erasing member 2, part of the clip part 104*b*, for example, the guide surface 104*d*, can be pressed to fit the cap 104 with the writing instrument body 3. When fitting the cap 104, the fingers do not touch the erasing member 2, so the surface of the erasing member 2 can be prevented from being contaminated with hand oil etc.

Note that, the structure of the clip part 104*b* which was explained in the present embodiment can be applied to attachment to not only the cap, but also the front cylinder and the back cylinder. The present invention was explained in detail based on specific embodiments, but a person skilled in the art could make various changes, corrections, etc. without departing from the claims and concepts of the present invention.

REFERENCE SIGNS LIST

1 writing instrument
2 erasing member
2*c* fitting hole
3 writing instrument body
4 cap
14 fitting part
15 connecting part
16 supporting wall
17 clearance space

The invention claimed is:

1. A writing instrument comprising an erasing member which is attached to a back end part of a writing instrument body or a front end part of a cap, wherein said end part has a fitting part which is arranged on a center axis and a connecting part which connects said end part and said fitting part, said erasing member has a fitting hole which receives inside said fitting part and said connecting part when said erasing member is attached, so that the fitting part contacts a portion of an inner surface of said fitting hole, while there is a clearance space between said connecting part and said inner surface of said fitting hole and wherein said writing instrument further comprises a supporting wall which surrounds a part of said erasing member, a side surface of said part of said erasing member being provided with an engagement projecting part, and said engagement projecting part and an inner circumferential surface of said supporting wall abutting against each other.

2. The writing instrument according to claim 1, wherein a flat part is provided at the side surface of said part of said erasing member.

3. The writing instrument according to claim 2, wherein an entrance part of said fitting hole has a taper part which becomes narrower the further toward the back.

4. The writing instrument according to claim 1, wherein an entrance part of said fitting hole has a taper part which becomes narrower the further toward the back.

* * * * *